United States Patent [19]

Kuipers

[11] Patent Number: 4,625,869

[45] Date of Patent: Dec. 2, 1986

[54] CARRIER FOR PACKAGING, SHIPPING AND TRANSPORTING COILED, HEAVY-WEIGHT PRODUCTS

[75] Inventor: Sytze A. Kuipers, Terhorne, Netherlands

[73] Assignee: Lankhorst Touwfabrieken B.V., Sneek, Netherlands

[21] Appl. No.: 824,539

[22] Filed: Jan. 31, 1986

[30] Foreign Application Priority Data

Dec. 30, 1985 [NL] Netherlands ..... 8503583

[51] Int. Cl.[4] ..... B65D 19/00

[52] U.S. Cl. ..... 206/600; 108/56.1

[58] Field of Search ..... 108/56.1, 56.3; 206/600, 597, 386; 220/23.2, 23.4

[56] References Cited

U.S. PATENT DOCUMENTS

| | | | |
|---|---|---|---|
| 3,650,224 | 3/1972 | Petix et al. | 108/56.1 |
| 3,752,087 | 8/1973 | Finke | 108/56.1 |
| 3,927,624 | 12/1975 | Hewson | 108/56.1 |
| 4,062,301 | 12/1977 | Pitchford | 108/56.1 |
| 4,079,907 | 3/1978 | Mykleby | 206/600 |
| 4,287,991 | 9/1981 | Donnelly | 206/600 |

*Primary Examiner*—Joseph Man-Fu Moy

*Attorney, Agent, or Firm*—Fleit, Jacobson, Cohn & Price

[57] ABSTRACT

A carrier for packaging, shipping and transporting coiled, heavy-weight products, said carrier being formed as a ring of a synthetic plastics material, comprising an upright rim, said ring being dividable into two ring halves, each having a pin and a hole for assembling the ring halves to form the carrier, thereby forming a double pin-and-hole joint. Each of the ring halves is provided on the inside with one or more reinforcing ribs of synthetic plastics material connected integrally with the ring wall and stabilizing said wall, while the ring wall and the reinforcing ribs have openings therein which, when the ring halves are assembled to form the carrier, result in the formation of a plurality of pairs of channels extending parallel to the ring plane.

4 Claims, 8 Drawing Figures

CARRIER FOR PACKAGING, SHIPPING AND TRANSPORTING COILED, HEAVY-WEIGHT PRODUCTS

The present invention relates to a carrier for packaging, shipping and transporting coiled products of heavy weight.

It is known to use square carriers made of wood for packaging, shipping and transporting coiled, heavy-weight products.

Examples of such coiled products are coils of tinplate, coils of rolled steel, coils of rolled aluminum, coils of paper. The coiled products mostly have a central core hole and the prior art square wooden carriers may therefore be fitted with an upright mandrel fitting in the core hole for improving the stability of the combination of square carrier and coiled product.

Current sizes for the prior art carriers are 1.50×1.50 m.

The prior art square wooden carrier have clear drawbacks for the purposes contemplated.

As the diameter of the coiled products varies, mostly the diameter of the product to be packaged will be smaller than the width of the carrier. This provides an unfavourable degree of loading or load factor in the case of storage and transport. The mandrel attached to the wooden carrier falls into the core hole of the coiled product to be packaged. As the size of the core hole of the coiled products to be packaged varies, the mandrel on the carrier will rarely have the same size as the hole. During transport, the product may thus be slightly shifted, after which this shifting is arrested by the mandrel. This will often result in a damage to the product at the side of the core hole. A wooden carrier with the product thereon cannot be transported in a vertical position by means of a hoisting sling, since the carrier is not designed for that purpose. Besides, a wooden carrier can absorb moisture, which may result in rust formation or other damage caused by moisture to the product thereon.

It is an object of the present invention to provide a novel, improved carrier of the above described type which does not have the above drawbacks.

According to the present invention the object described in the preceding paragraph is achieved by providing a carrier that is characterized in that it is formed as a ring from a synthetic plastics material comprising an upright rim, which ring is dividable into two ring halves, each having a pin and a hole for assembling the ring halves to form the carrier, thereby forming a double pin-and-hole joint; each of the ring halves has on the inside one or more reinforcing ribs made of synthetic plastics material connected integrally with the ring wall and stabilizing the same, while the ring wall and the reinforcing ribs have openings therein which, when the ring halves are assembled to form the carrier, result in the information of a plurality of pairs of channels extending parallel to the ring plane.

The carrier according to the present invention has been given an annular shape to accommodate the basic form of the coiled products to be handled by the carrier. In combination with the divided design of the carrier and the upright rim disposed around the carrier, it is possible within relatively broader limits to use the same carrier as a suitably embracing packing for coiled products of varying diameter.

The upright rim of the carrier according to the present invention moreover offers a point of engagement so that, when the carrier is used in practice, the two portions of the carrier can be kept interconnected in a simple but entirely safe and secure manner. According to a further embodiment of the carrier according to the present invention, the upright rim of the ring is fitted on the outside along its circumference with a troughed recess adapted to serve as a housing for a packaging strip including a fixing member, which is adapted to keep the two carrier halves together with an adjustable, desired clamping force.

Various types of synthetic plastics material can be chosen as the material from which the carrier according to the present invention is made. A suitable material is e.g. low-density polyethylene.

The conventional fillers such as chalk, talc, glass fibres, paper fibres may or may not be added to the synthetic plastics material.

The weight of the carrier can be reduced by using foaming agents conventional for the synthetic material. Instead of new, i.e. unused synthetic plastics materials, the carrier may also be made of synthetic plastics waste material, whether or not with addition of the above fillers, or of mixtures of synthetic plastics waste material and/or paper and/or aluminum foil.

One embodiment of the carrier according to the present invention will now be described, by way of example, with reference to the accompanying drawings, in which.

Figure 1:
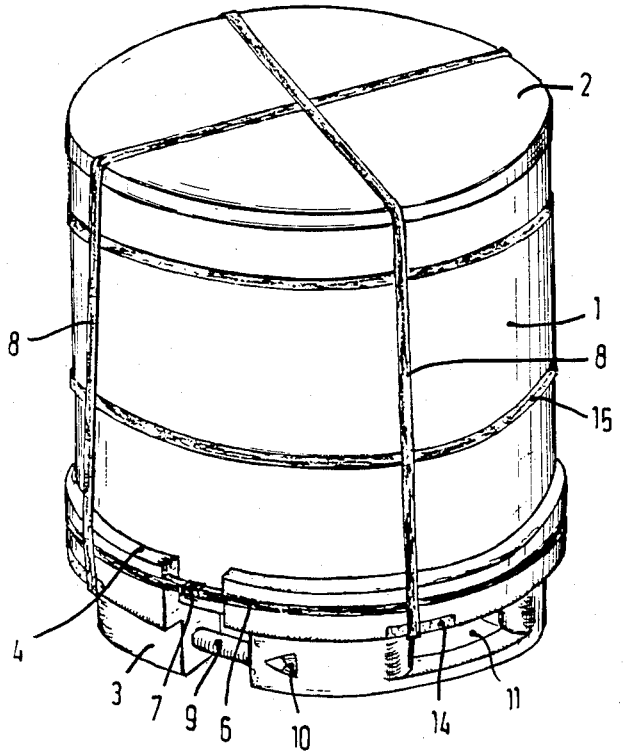
FIG. 1 is a perspective elevational view of a coiled product in entirely packaged form, using a carrier according to the present invention.

The packaged coiled product 1 (FIG. 1) e.g. consisting of coiled tin or steel, aluminum or paper is placed inside the rim 4 of a carrier 3 consisting of two halves. Said carrier 3 is made of low-density polyethylene and is constructed in such a manner that a pin 9 of one half slides into hole 10 of the other half, to a greater of lesser extent, thus rendering the carrier suitable for coiled products of varying diameter.

Figure 2:
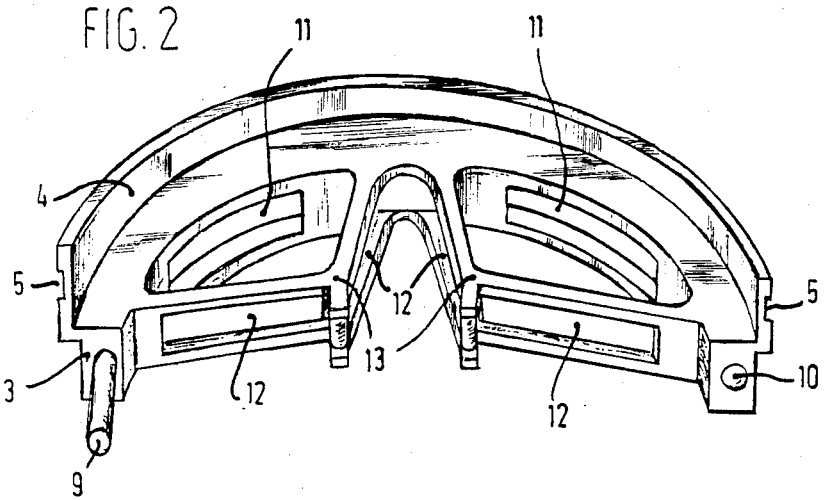
FIG. 2 is a perspective top view of one of the carrier ring halves.

FIG. 2 shows one half of the carrier 3 with the pin 9 and the hole 10 and the upright rim 4 preventing the coiled product to be packaged on the carrier from being shifted during the transport.

Figure 3:
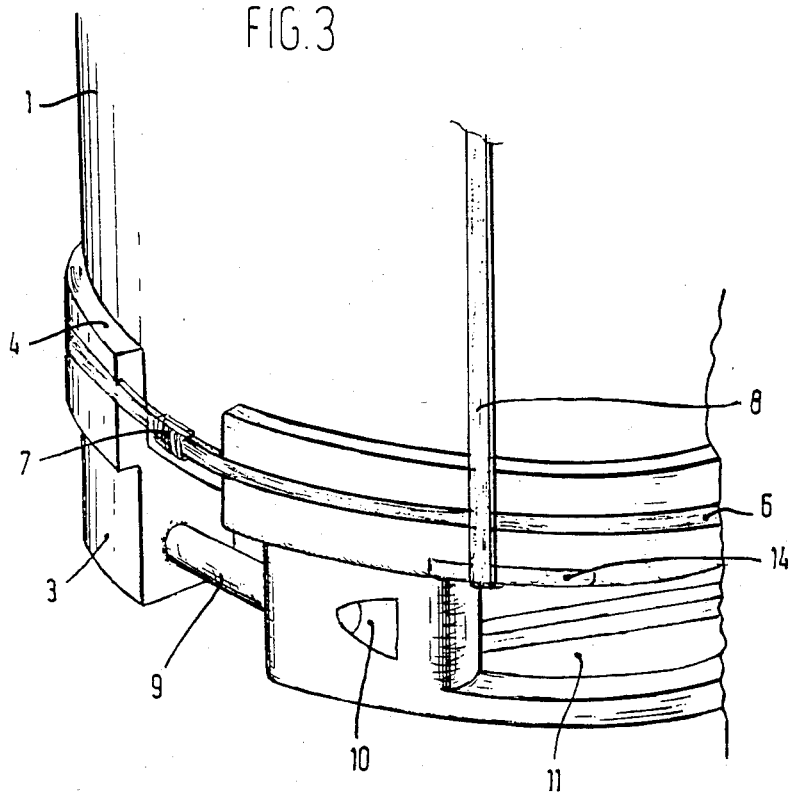
FIG. 3 is a perspective side view of the jointing region of the two carrier halves.

In order to clamp the two carrier halves about the cylindrical product, and to maintain these in position, use is made of packaging strip 6, which may be made of steel or other materials, such as strapping of polyester, nylon or any other synthetic plastics material. Strip 6 is secured by means of a suitable clamp (FIGS. 1 and 3). Also other clamping means, e.g. synthetic plastics clamp or frictional melt fixation van be employed.

The packaging strip 6 is disposed in a slot 5 formed in the carrier (FIGS. 2 and 3).

The packaged coiled product 1 is retained in place on the carrier by vertical packaging strips 8 (FIG. 1).

Strips 8, just as strip 6, may be made of steel or another material, e.g. strapping of polyester, nylon or any other synthetic plastics material, and may also be secured with a clamp, such as clamp 7.

The vertical strips 8 also retain in place a cover (FIG. 1) as an additional protection, made of a suitable material.

Figure 4:
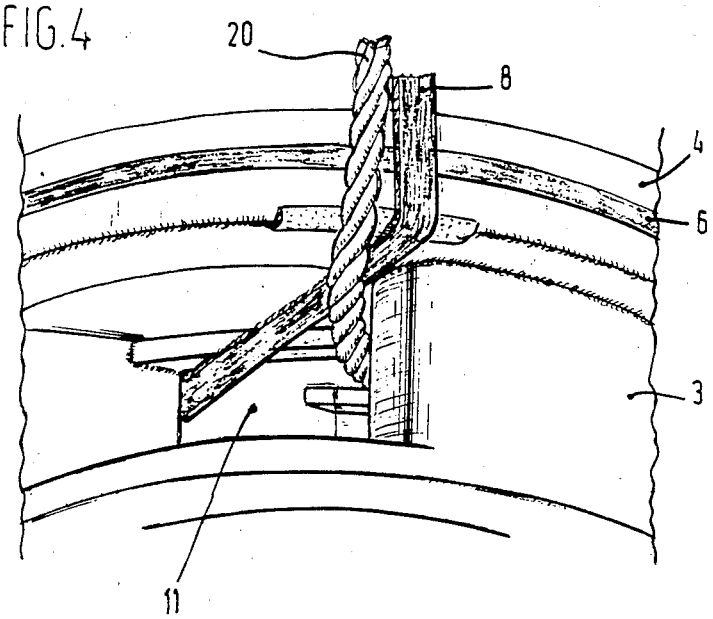
FIG. 4 is a perspective side view of the region around an opening disposed in the ring wall of the carrier, a packaging strip and a hoisting sling being inserted through the opening.
Figure 7:
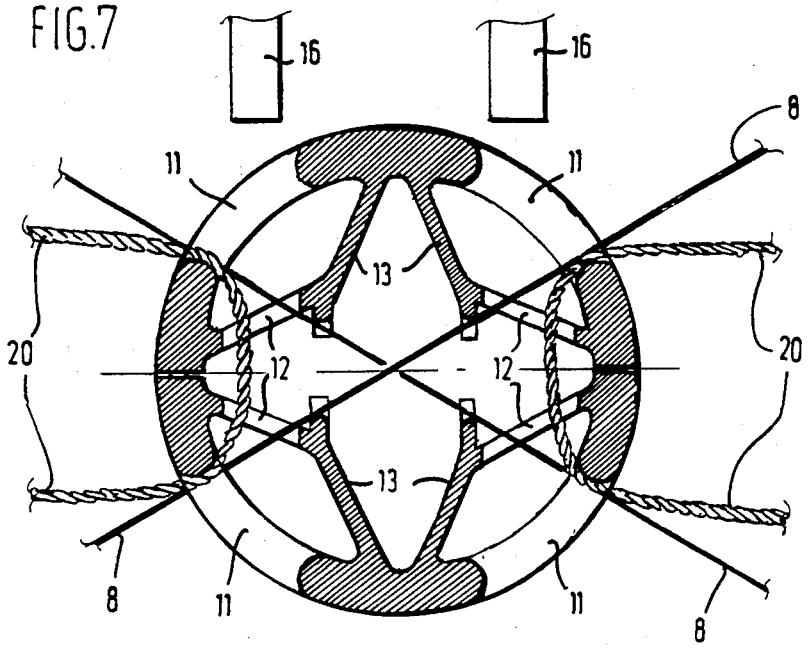
FIG. 7 is a top view of a radial cross section of the carrier, with a pair of packaging strips and a pair of hoisting slings being inserted through openings in the carrier wall.

The vertical strips 8 are passed through openings 11 in the carrier ring wall (FIGS. 1 and 4), and through the openings 12 in the reinforcing ribs 13 (FIGS. 2, 4 and 7) in such a manner that shifting is excluded (FIG. 7). FIG. 7 also shows that and how the vertical packaging strips 8 are inserted crosswise through the carrier. In order to prevent damage to the carrier in the case of repeated re-use, it is provided with metal protecting pieces, such as the protecting plates 14 (FIGS. 1, 3 and 4) anchore in the carrier material.

As shown in FIG. 1 horizontal strips 15 may be wrapped about the coiled product, serving for retaining in place the packaging material wrapped about the coiled product.

Figure 5:
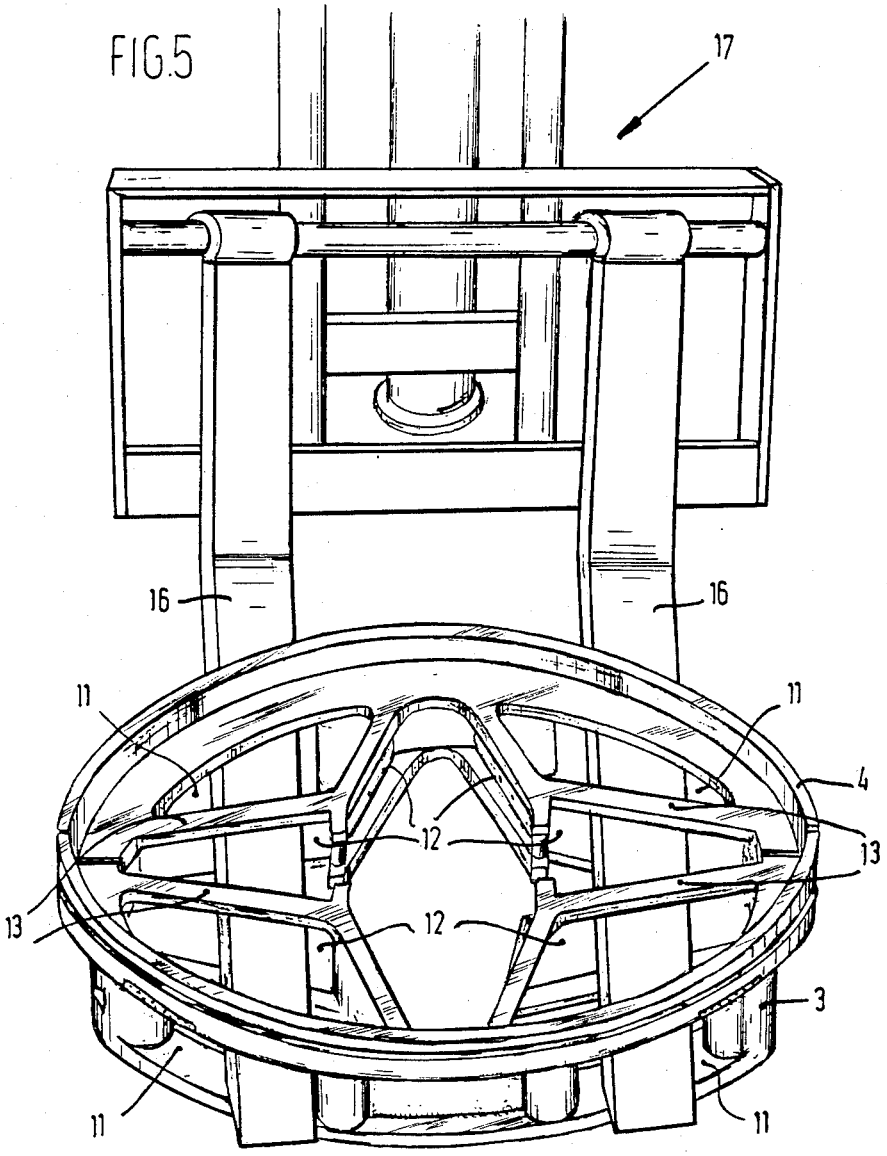
FIG. 5 is a perspective top view of a carrier in the condition in which it is carried by the fork of a forklift truck.
Figure 6:
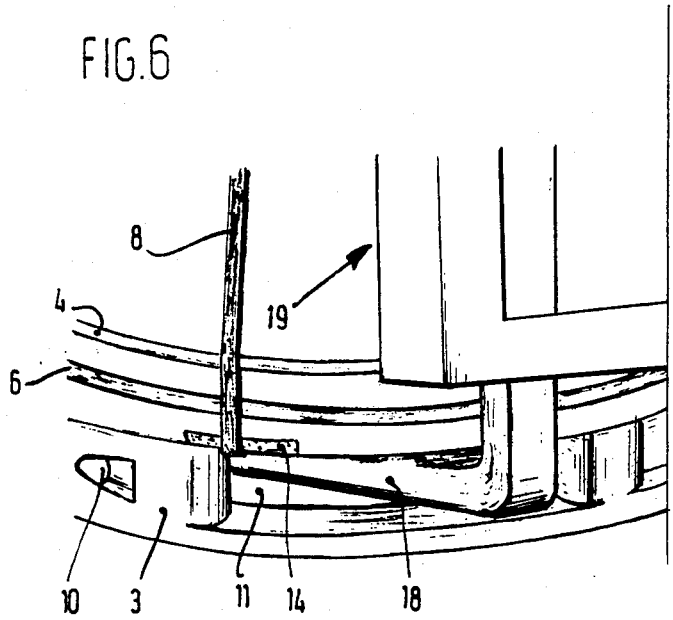
FIG. 6 is a perspective side view of a carrier carried by carrier hooks of a loading device.

The openings 11 in the carrier ring wall and the openings in the reinforcing ribs 13 (FIG. 2) are so positioned relating to each other that the carrier offers not only passageways for packaging strips and/or hoisting slings (FIG. 7) but also channels through which e.g. the fork of a forklift truck 17 (FIG. 5) or the carrier hooks 18 of a loading device 19 (FIG. 6) can be inserted.

The coiled product in complete packing as shown in FIG. 1 can then be displaced vertically and/or horizontally by means of the forklift truck or loading device. In constructing the carrier, allowance has been made for the fact that the weight of the above mentioned coiled products to be transported in practice may be as heavy as 25 tons. The upright rim 4 then functions as a protection of the coiled product during the insertion of the fork and/or other parts of a transport means.

In cases in which the coiled product with packing is displaced vertically, by means of cables 20, the cables 20 are inserted through openings 11 of the carrier, i.e. through the same openings through which also the fork of a forklift truck is inserted. The manner of insertion through the openings is shown in FIG. 7. The cables 20 come to lie against the metal protecting plates 14 (FIG. 4) under the influence of the hoisting tension, so that the carrier cannot be damaged.

Figure 8:
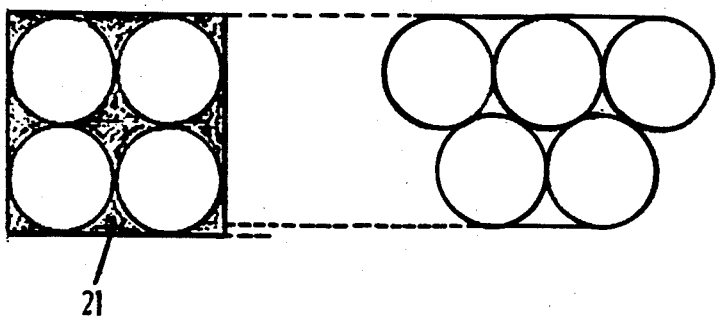
FIG. 8 is a diagrammatic top view of the degree of loading to be obtained when use is made of the known square wooden carrier or of the round carrier according to the present invention.

The technical possibilities and advantages of the carrier according to the present invention can be summarized as follows:

The combination of packaged coiled product and carrier can be stacked during transport and/or storage in 4 layers, in contrast to the prior art method of packaging and transporting by means of wooden carriers, enabling the stacking of only 3 layers. The round basic form of the carrier provides a favourable degree of loading during storage and transport. This is clearly shown in FIG. 8, in which the left part of FIG. 8 represents the load when use is made of a prior art square wooden carrier 21 and the right portion shows the load when use is made of round carriers according to the present invention. When use is made of the conventional wooden square carriers having the normal size of 1.50×1.50 m, only 1 carrier width of truck floor area can be utilized therefor both during the dispatch as outward cargo with the coiled product thereon and during the return as returned empties, in connection with the statutory maximum truck width of 2.30 m. As the conventional wooden carrier is not dividable, the return of used wooden carriers is also disadvantageous due to the fact that even then only 1 carrier width of truck floor area can be utilized. This is in contrast to the carrier according to the present invention, which when returned as empties are again disassembled to two halves so that during transport in a truck a higher degree of loading can be obtained. Moreover, the wooden carrier is considerably heavier: a weight that is 50% heavier than the weight of the synthetic plastics carriers according to the present invention. The lighter weight of the carriers according to the present invention is naturally not only advantageous when they are returned as empties, but also during the actual use when a lighter weight contributes to ease of handling.

Although the carrier according to the present invention can be suitably designed in standard sizes, it can be employed within broad limits for an all-size packing for storage, shipping and transport of cylindrical products of both varying weight, or from 2 to 25 tons, and varying diameter. As the carrier according to the present invention is made of synthetic plastics material, it does not absorb water, so that the product carried by it cannot be damaged by moisture through rust formation or otherwise, in contrast to the prior art square carrier of wood. Moreover, the life of the synthetic plastics carrier according to the present invention is longer than that of a wooden carrier, which is a distinct advantage if it is considered that the carrier is the most valuable part of the packing.

The divisibility of the carrier according to the present invention, combined with the presence of an upright rim ensures an enclosure of the packaged coiled product which fits all sizes so that the packaged product is prevented from sliding. This fact and the fact that the upright rim functions in general also as a stop shoulder, ensures a damage-free transport of the packaged product.

Naturally, alterations of the carrier as described in the above and shown in the drawings are possible without departing from the scope of the present invention.

I claim:

1. A carrier for packaging, shipping and transporting coiled, heavy-weight products, characterized in that the carrier is formed as a ring of a synthetic plastics material, comprising an upright rim, said ring being dividable into two ring halves, each having a pin and a hole for assembling the ring halves to form the carrier, thereby forming a double pin-and-hole joint; each of said ring halves is provided on the inside with one or more reinforcing ribs of synthetic plastics material connected integrally with the ring wall and stabilizing said wall, while the ring wall and the reinforcing ribs have openings therein which, when the ring halves are assembled to form the carrier, result in the formation of a plurality of pairs of channels extending parallel to the ring plane.

2. A carrier according to claim 1, characterized in that the upright rim of the ring has a troughed recess, on the outside along its circumference.

3. A carrier according to claim 1, characterized in that metal protecting members are anchored in the rim regions of the openings in the ring wall at the side thereof facing the cylindrical product.

4. A carrier according to claim 1, characterized in that the carrier is made of synthetic plastics material.

* * * * *